US008282536B2

(12) United States Patent
Latronica

(10) Patent No.: US 8,282,536 B2
(45) **Date of Patent: *Oct. 9, 2012**

(54) THERAPEUTIC BODY STRAP

(76) Inventor: Miguel James Latronica, Riverwoods, IL (US)

( * ) Notice: Subject to any disclaimer, the term of this patent is extended or adjusted under 35 U.S.C. 154(b) by 155 days.

This patent is subject to a terminal disclaimer.

(21) Appl. No.: 12/463,368

(22) Filed: May 8, 2009

(65) Prior Publication Data

US 2010/0285939 A1 Nov. 11, 2010

(51) Int. Cl.
*A63B 21/00* (2006.01)
*A63B 21/02* (2006.01)

(52) U.S. Cl. ..... 482/121; 482/91; 482/907; 482/126; 482/139

(58) Field of Classification Search ..... 482/124–126, 482/91, 907; 119/770; 128/876, 878–882
See application file for complete search history.

(56) References Cited

U.S. PATENT DOCUMENTS 3,677,543 A * 7/1972 Richardson ..... 482/129
4,220,328 A * 9/1980 Crush, Jr. ..... 482/92
4,378,921 A * 4/1983 Allen et al. ..... 244/151 R
4,667,624 A 5/1987 Smith
4,909,505 A 3/1990 Tee
4,948,117 A * 8/1990 Burke ..... 482/55
5,209,712 A 5/1993 Ferri
5,328,433 A 7/1994 Berman
5,433,688 A * 7/1995 Davies ..... 482/124
5,518,480 A * 5/1996 Frappier ..... 482/124
5,921,903 A * 7/1999 Lawrence ..... 482/140
5,993,362 A * 11/1999 Ghobadi ..... 482/124
6,036,625 A * 3/2000 Woodruff ..... 482/121
6,039,677 A * 3/2000 Spletzer ..... 482/105
6,047,665 A * 4/2000 Deveaux ..... 119/770
6,125,792 A * 10/2000 Gee ..... 119/770
6,620,052 B2 * 9/2003 Piatt ..... 473/208
6,651,594 B1 * 11/2003 Bagwell ..... 119/770
6,658,666 B2 * 12/2003 Schweer ..... 2/94
6,726,606 B2 4/2004 Jacobsen
6,921,354 B1 7/2005 Shifferaw
7,066,181 B2 * 6/2006 West ..... 128/875
7,223,212 B2 5/2007 DiOrio et al.
7,255,666 B2 8/2007 Cardenas
7,261,679 B2 * 8/2007 Sload ..... 482/124
7,284,504 B1 10/2007 Purschwitz et al.
7,318,810 B1 * 1/2008 Benson ..... 601/45
7,341,025 B1 * 3/2008 Streeter et al. ..... 119/857
7,357,099 B2 4/2008 Smith et al.
(Continued)

OTHER PUBLICATIONS

PCT International Search Report and Written Opinion, International Application No. PCT/US10/33985, mailed Oct. 15, 2010.

*Primary Examiner* — Stephen Crow
(74) *Attorney, Agent, or Firm* — The Eclipse Group LLP

(57) ABSTRACT

A therapeutic body strap having a first loop and a second loop. Each loop is made of a strip of material. A central strip having a fixture point such that the first and second loops are connected to the central strip at the fixture point. The strap further includes an attachment portion extending from the central strip for attachment to an attachment point on a stationary object. The first and second loops are configured to snugly surround a user's body parts to allow the user to stretch by creating a tension in the attachment portion.

10 Claims, 5 Drawing Sheets

U.S. PATENT DOCUMENTS

| | | | | |
|---|---|---|---|---|
| 7,384,382 | B2 * | 6/2008 | Farrah et al. | 482/124 |
| 7,481,747 | B2 * | 1/2009 | Lechleiter | 482/57 |
| 8,002,681 | B2 * | 8/2011 | Kopp | 482/124 |
| 2003/0162636 | A1 * | 8/2003 | West | 482/69 |
| 2005/0279289 | A1 * | 12/2005 | Sattler | 119/805 |
| 2006/0040807 | A1 * | 2/2006 | Miller | 482/124 |
| 2006/0249097 | A1 | 11/2006 | Goldberg | |
| 2007/0004571 | A1 * | 1/2007 | Gonzalez | 482/124 |
| 2007/0015640 | A1 * | 1/2007 | Demeniuk | 482/124 |
| 2007/0173382 | A1 * | 7/2007 | Axelrod | 482/91 |
| 2011/0247127 | A1 * | 10/2011 | Pou et al. | 2/227 |
| 2012/0053026 | A1 * | 3/2012 | Kopp | 482/124 |

* cited by examiner

THERAPEUTIC BODY STRAP

BACKGROUND OF THE INVENTION

1. Field of the Invention

The present invention relates to a strap that enables therapeutic exercise, and more particularly, to a therapeutic body strap configured to enable stretching of selected body parts.

2. Description of Related Art

Upper and lower back pain afflicts a countless number of individuals at some point in their lives. The pain can be debilitating and relief difficult to come by. When well, many back pain sufferers devote time and money to exercise seeking to reduce the instances of back pain. Yoga, Pilates, and systems for exercise that both stretch and strengthen the body core (abdominal and lower back section) all help to reduce the chance of having back pain.

Exercise does provide long-term benefits and helps reduce occurrences of back pain. However, for some causes of back pain, exercise may not provide adequate relief. For example, sciatica is a form of back pain affecting the muscles, bones and ligaments surrounding the sciatic nerve at the base of the spine. Typically, the pain is caused by muscle tightness or muscular imbalances in areas that remain unaffected by most exercises.

Apparatuses such as straps or bands or other types of exercise assisting devices may improve the effectiveness of many exercises. For example, straps are often used in yoga to deepen a stretch. Such straps are typically most effective for assistance in stretching the hamstrings, or quadriceps, or the erector spinae, and/or other muscles that flex and contract in a substantially linear fashion. Many instances of back pain are the result of problems with muscles or other body parts that do not move linearly. Rather, such muscles and/or other body parts may be part of angular motion. Sciatica, for example, may be associated with a tightness in muscles and ligaments surrounding the area in which the base of the attaches to the pelvis. These muscles, ligaments, and/or tendons flex and extend roughly angularly on a plane that is substantially normal to the spinal column. These muscles, ligaments and/or tendons may not be easily stretched or strengthened by exercise.

There is a need for exercise apparatus that permits exercise of muscles and other body parts that are difficult to stretch and/or exercise effectively.

SUMMARY

In view of the above, a strap is provided with a first loop and a second loop. Each loop is made of a strip of material. A central strip having a fixture point such that the first and second loops are connected to the central strip at the fixture point. The strap further includes an attachment portion extending from the central strip for attachment to an attachment point on a stationary object. The first and second loops are configured to snugly surround a user's body parts to allow the user to stretch by creating a tension in the attachment portion.

Various advantages, aspects and novel features of the present invention, as well as details of an illustrated embodiment thereof, will be more fully understood from the following description and drawings.

Other systems, methods and features of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The description of examples of the invention below can be better understood with reference to the following figures. The components in the figures are not necessarily to scale, emphasis instead being placed upon illustrating the principles of the invention. In the figures, like reference numerals designate corresponding parts throughout the different views.

DETAILED DESCRIPTION

In the following description of example implementations, reference is made to the accompanying drawings that form a part hereof, and which show, by way of illustration, example implementations of the invention. Other examples may be utilized and structural changes may be made without departing from the scope of the invention.

Figure 1:
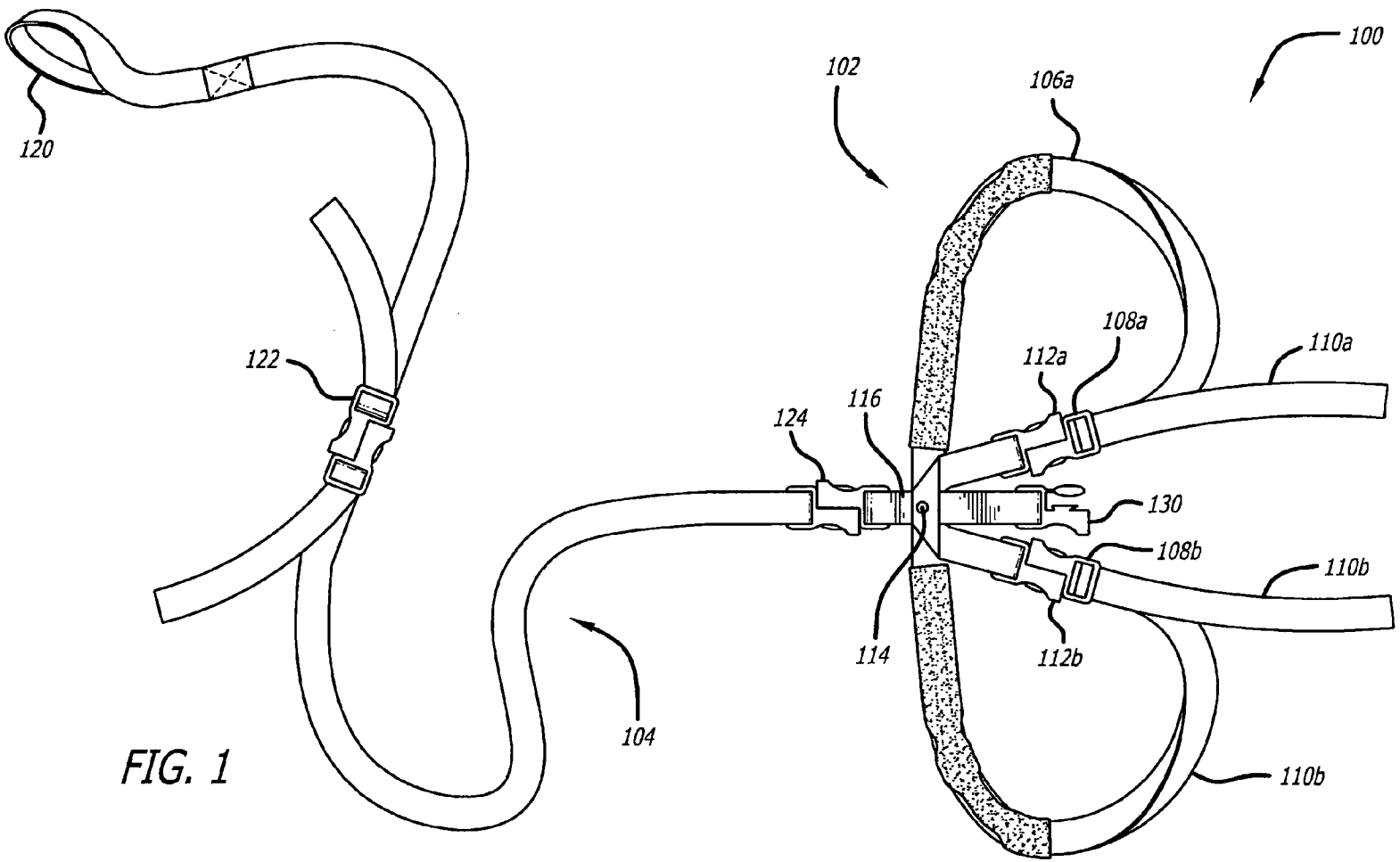
FIG. 1 is a top view of an example of a therapeutic strap.

FIG. 1 is a top view of an example of a therapeutic strap 100. The therapeutic strap 100 includes a harness portion 102 and an attachment portion 104. The harness portion 102 includes a first loop 106*a* and a second loop 110*b*. In an example use of the body strap 100, the first loop 106*a* may be used to wrap around the user's leg, such as for example, the left leg. The second loop 106*b* may be used to wrap around the user's other leg, such as for example, the right leg. The loops 106*a,b* may also be used to wrap around other body parts, such as the arms. The two ends 306*a* and 306*b* may also be connected to form a larger loop that may be placed around the pelvis or torso. The user may then stand with his or her side towards the point of attachment to perform a side stretch, or facing the point of attachment to perform back bends as described below with reference to FIG. 5C.

The first and second loops 106*a,b* may each include a length adjuster 108*a,b* to allow the user to adjust the size of the loop 106*a,b*. In use, the length adjuster 106*a,b* adjusts the tightness of the loops 106*a,b* around the user's body parts; for example, the user's legs. The length adjusters 108*a,b* may be used by pulling on an excess strap length 110*a*, 110*b* on each loop 106*a,b*. Each loop 106*a,b* may also include a first and second connecting device 112*a,b*. The first connecting device 112*a* permits forming the first loop 106*a* by connecting one extension of the loop 106*a* with another extension of the loop 106*a* with the first connecting device 112*a*. Similarly, the user may form the second loop 106*b* by connecting a portion of the second loop 106*b* with another portion of the second loop 106*b* with the second connecting device 112*b*.

The first and second loops 106*a,b* may be attached to a central strip 116 at a loop attachment area 114. The first and second loops 106*a,b* may extend from opposite sides of the loop attachment area 114. The central strip 116 may extend from both sides of the loop attachment area 114. One side of the loop attachment area 114 may extend and attach to a third connecting device 124. The third connecting device 124 may be used to attach the attachment portion 104 to the harness portion 102. In addition, the body strap 100 in FIG. 1 shows a second extension 130 from the loop attachment area 114 having a connector to which a user may add a weight or some sort of handle and/or tether to assist in a selected exercise. The attachment portion 104 may include a length or tension adjuster 122 and affixing device 120.

The loops 106*a,b*, the central strip 130, and the attachment portion 104 may be made of nylon, cotton, canvas, rubber, plastic, or any other suitable material. The material may be a type of material that is molded, or formed by some other means. The material may be made with minimal elasticity to allow the strip material to stretch, at least slightly, during use. The material should not be too elastic to provide sufficient tautness in the attachment portion 104 to provide the intended benefit. The first connecting device 112*a*, second connecting device 112*b*, and third connecting device 124 may be implemented with buckles, snaps, clips, or any other device for connecting an end of one strip to another end of a strip. The length adjusters 108*a,b*, 122 may be implemented as a looping component on the connecting devices 112*a,b* through which the strip may be looped and which maintains the tension of the loops 106*a,b*.

In one example use of the body strap 100, a user may clip the first connecting device 112*a* to wrap the first loop 106*a* around the user's left leg. The user may clip the second connecting device 112*b* to wrap the second loop 106*b* around the user's right leg. The user may then pull on the excess strap lengths 110*a,b* on each loop 106*a,b* to tighten the loops 106*a,b* around each leg. The user may then attach the attachment portion 104 to the harness portion 102 by joining their respective ends at the third connecting device 124. The attachment portion 104 is affixed to a stationary and secure object, such as for example, a door knob, a fence post, a tree, a railing, a banister, a handrail, or some other convenient object that is relatively immobile and able to support the pulling force of the user's bodyweight. The attachment portion 104 may be secured by hooking or tying the end of the attachment portion 104 using the affixing device 120 to the point of attachment on the secure object (e.g. eyebolt, door, sign-post or tree).

In another example, the attachment portion 104 may include a strap material having two ends that may be wrapped horizontally around the entire door. The attachment portion 104 may be wrapped around the door so that the loops extend in the direction of the door closing. In use, the attachment portion pulls against the closed door, which is supported by the door frame.

The attachment portion 104 is shown in FIG. 1 as being a separate length of strip that connects to the central strip 116 for attachment to a stationary and secure object. However, the attachment portion 104 may also be an extension of the central strip 116 adapted to attach to the stationary and secure object.

Once the body strap 100 is secured, the user may walk away from the point of attachment until the attachment portion 104 becomes taut when it is properly distanced from the attachment and provides a pulling force on the point of attachment. When the pulling force begins, the therapeutic effects of the body strap may begin to work.

The user may adjust this force in order to vary the therapeutic effect. For example, the user may grip a chair seat or the back of a chair and resist and/or rest the body weight on the chair. The user may also target or use other muscles to create an eccentric contraction. Increasing the force by increasing the resistance against the attachment point intensifies the therapeutic effect. The user may also be in a different position, such as on his knees. The user may bend forward or backward (to create flexion or extension), and/or bend laterally to stretch other muscles and further intensify the stretch of the on the targeted body part(s). The user may also put the loops around different body parts including, but not limited to the legs, neck, shoulders, arms, back, knees and feet.

Figure 2:
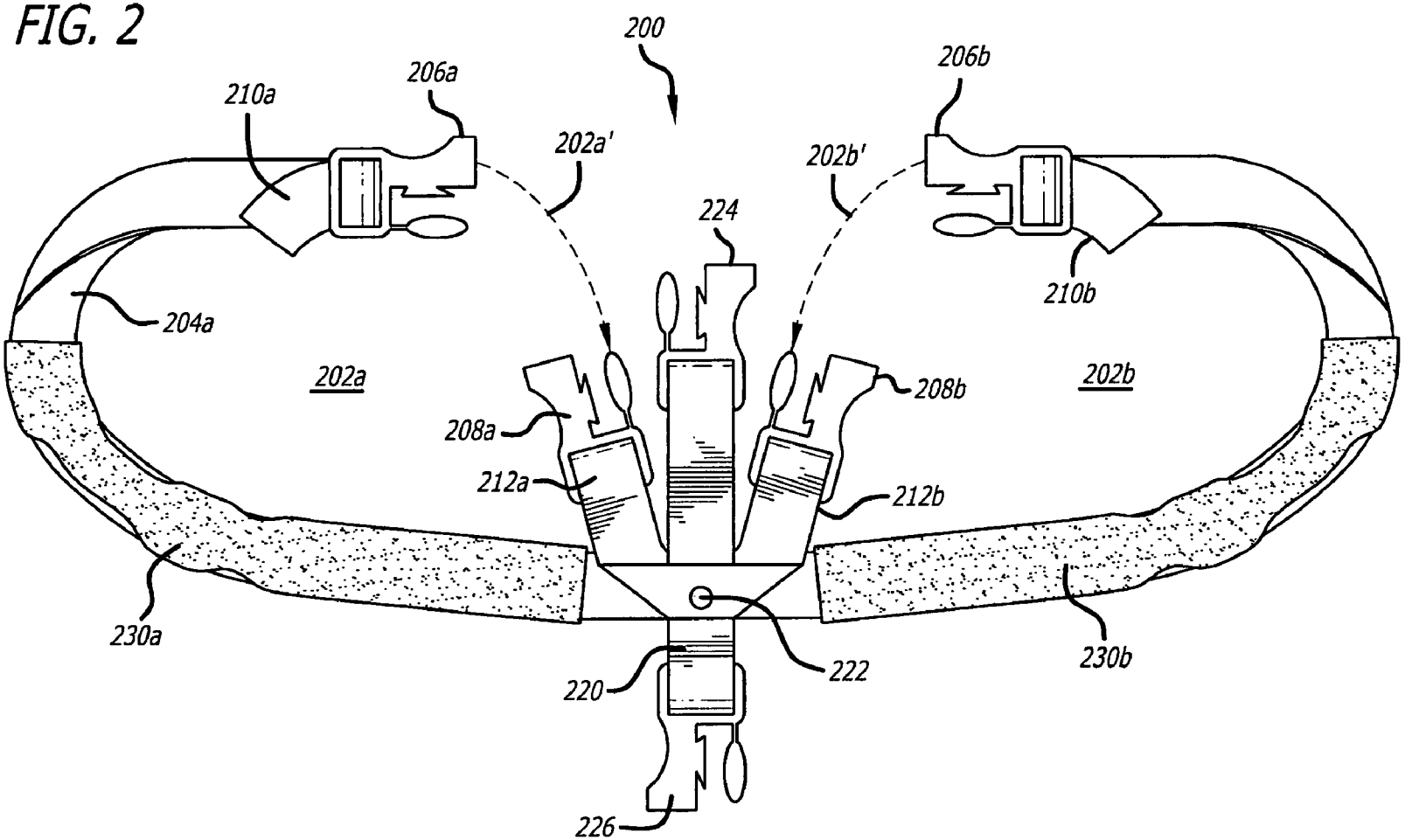
FIG. 2 is a top view of a harness portion of the therapeutic strap in FIG. 1.

FIG. 2 is a top view of a harness portion 200 of an example therapeutic strap. The harness portion 200 includes first and second loops 202*a,b*. The first loop 202*a* is formed by connecting a first loop length 204*a* to a second loop length 212*a* by mating a first buckle member 206*a* at the end of the first loop length 204*a* to a second buckle member 208*a* on the end of the second loop length 212*a*. The second loop 202*b* is formed by connecting a third loop length 204*b* to a fourth loop length 212*a* by mating a third buckle member 206*b* at the end of the third loop length 204*b* to a fourth buckle member 208*b* on the end of the fourth loop length 212*b*. Closure of the first and second loops 202*a,b* may be accomplished as shown at 202*a*' and 202*b*', respectively, as shown in FIG. 2. The first and third loop lengths 204*a,b* are affixed to a central strip 220 at a fixture point 222. The second and fourth loop lengths 212*a,b* are also affixed to the central strip 220 at the fixture point 222.

The central strip 220 also includes buckle members 224, 226 on each end of the central strip 220. The harness portion 200 also includes a first foam pad 230*a* on the first loop length 204*a* of the first loop 202*a*, and a second foam pad 230*b* on the third loop length 204*b* of the second loop 202*b*. The foam pads 230*a,b* may be used on the harness portion 200 to reduce discomfort that may arise when the loops 202*a,b* are tightened on a user's body.

Figure 3:
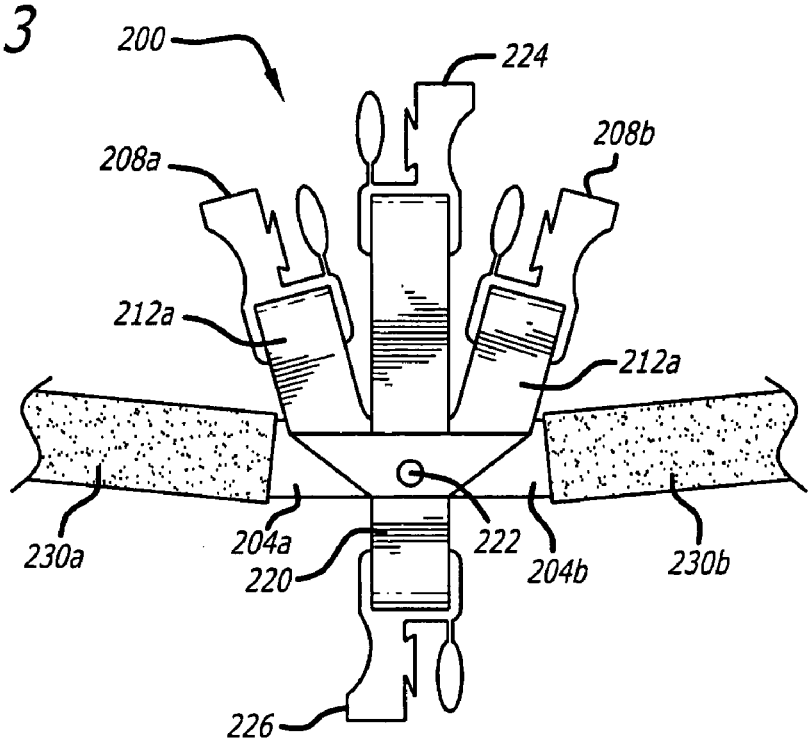
FIG. 3 is a close-up view of the harness portion of FIG. 2.

FIG. 3 is a close-up view of the harness portion of FIG. 2. FIG. 3 illustrates an example implementation of the harness portion 200. The first and third loop lengths 204*a,b* may be implemented as a single strip of suitable material attached at the fixture point 222 to the central strip 220. The central strip 220 may be a single strip of suitable material with the buckles 224, 226 attached at the opposite ends. The second and fourth loop lengths 212*a,b* may also be implemented as a single length of strip of suitable material attached to the central strip 220 at the fixture point 222. The fixture point 222 may be a rivet. The three strips of material shown in FIG. 4 may also be sown to one another around the fixture point 222 to ensure a secure attachment.

It is noted that the portion of the central strip 220 extending to the first buckle 224 is shorter than the portion of the central strip 220 that extends to the second buckle 226. The difference in length provides a choice of buckles 224, 226 to which the attachment portion 104 (FIG. 1) may be connected. The buckles provide a choice of levels of intensity with which the user may stretch the target body parts. For example, if the user places the loops around each leg as described above with reference to FIG. 1 with the attachment portion 104 attached to the first buckle 224 attached to the shorter portion of the central strip 220, the user would obtain a more intense stretch than if the user attached the attachment portion 104 to the second buckle 226.

Figure 4:
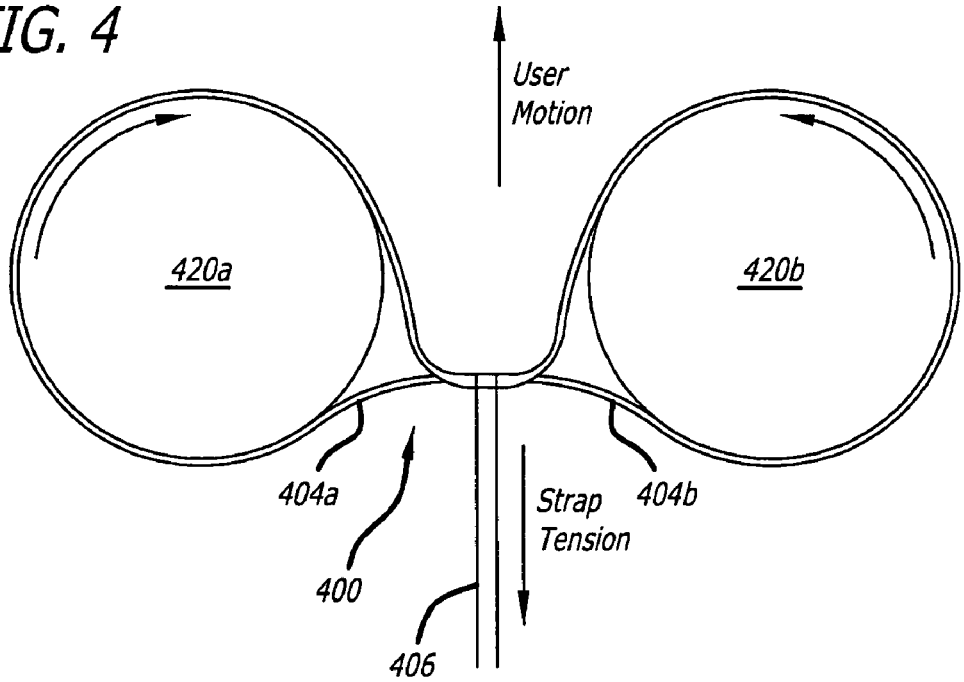
FIG. 4 is a schematic diagram illustrating use of the therapeutic strap.

FIG. 4 is a schematic diagram illustrating use of the therapeutic strap. FIG. 4 shows a first loop 404*a* snugly wrapped around the user's left leg 420*a*, and a second loop 404*b* snugly wrapped around user's right leg 420*b*. The connecting devices and adjusting devices are not shown for purposes of description. An attachment portion 406 is pulled in a direction indicated by strap tension while the user moves forward in the direction shown as user motion. The user's motion combined with the strap tension creates an angular motion at the first and second loops 404*a,b*. The first loop 404*a* around the left leg 420*a* moves in a clockwise angular motion. The second loop 404*b* around the right leg 420*b* moves in a counter-clockwise angular motion. The angular motion by the loops 404*a,b* rotate the left and right legs 420*a,b* inward to stretch the pelvic area and legs.

The user may stretch the area by carefully moving away from the attachment point to create a tension in the attachment portion. The user may intensify the stretch and include other muscles in the stretch by bending at the waist, or by getting into selected position, or pose, such as an all-fours position similar to the "down dog" pose in yoga. By varying the user's position while the attachment portion is taut, the user may stretch different groups of muscles including parts of the body that are difficult to stretch by other means. Use of the therapeutic strap as shown in FIG. 4 may allow the user to stretch groups of muscles that may include the user's adductors, psoas, iliacus, gluteus maximus, as well as the piriformis, quadratus femoris and the other smaller external rotators of the hip. The angular motion created also addresses the tensor fascia latae and the iliotibia band.

Use of the therapeutic body strap as described above with reference to FIG. 4 may benefit the user's various body parts as follows:

1. Legs: When the user's hip rotators are tight, the legs and feet may tend to turn outward (abduct) causing pain and tightness. Tightness in the hip rotators may also cause various forms of nerve impingement. The ligaments and tendons of the knees are overstretched causing the knees and feet to experience occasional pain that may be severe as well as general weakening. The therapeutic body strap may be used to re-align the pelvis, sacrum, legs, knees and feet of the user by helping to reduce sacral nutation (rotation of the sacrum) and by alleviating unnecessary pressure on the two hips that may be caused by the head of the femurs in the hip sockets. The body strap also works to reduce perineal and sciatic nerve impingement. The therapeutic body strap may also work with the semi-membranous and semi-tendinosus muscles, as well as the biceps femoris and sortorius muscle. The body strap may also work to balance hyper- and hypo-tonicity in the muscles of the legs.
2. Hips and low back: The body strap creates an isometric action in the adductors, which may help to reset the hip joint by balancing the adductor muscles. An internal rotation of the hips is thus encouraged as a counterbalance to the otherwise tight hip, or tight external rotators, which may cause severe pain in the low back and restrict blood flow to the lower body chain. The body strap allows the user to maintain a more neutral spine by relaxing the tight muscles (hamstrings) and strengthening the weaker ones (abdominals). The release of all of these muscles and tendons alleviate sacral nutation, which may impinge the sacral nerves causing intense pain and severe restriction of movement.
3. Torso and mid back: Muscle imbalances affect the spine in a variety of ways. For example, weak abdominal muscles cause the spine to sag or collapse. The hip flexors may then weaken causing a more pronounced curvature (lordosis) in the low back. Tight hamstrings may also rotate the pelvis backwards causing (Kyphosis) slouching.

The therapeutic body strap may be used in a variety of ways to bring relief to various body parts. The therapeutic body strap works by activating the whole neuromuscular axis as each part of the body is exercised. The body strap helps to re-educate the sensory and motor feedback loops throughout the body and to work with muscular imbalances via the muscle spindle (lengthening) and Golgi tendon organ (tension) systems. The body strap permits the user to hold many different muscular tensioning patterns, which include both resistance and resting muscular states.

Figure 5A:
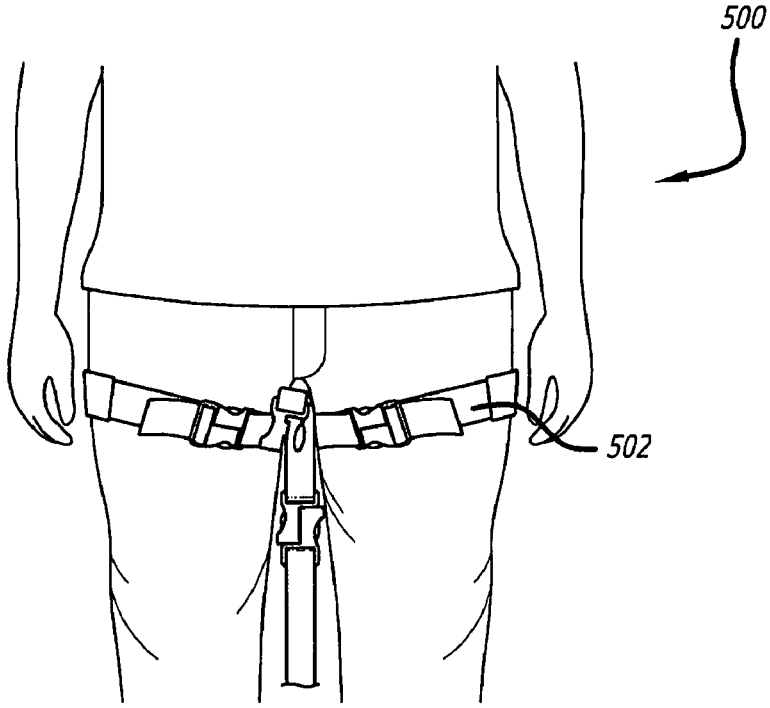
FIGS. 5A-5D depict different uses of the therapeutic strap.

FIGS. 5A-5D illustrate ways in which the therapeutic body strap 100 (FIG. 1) described above may be used for exercise and/or stretching different body parts. FIG. 5A shows a user 500 wearing the therapeutic body strap 502 in the manner described above with reference to FIGS. 1 and 4. The body strap 502 is shown high up on the user's legs, however, the user may vary the muscles stretched and the groups of muscles stretched by placing the body strap 502 higher or lower on the user's legs.

Figure 5B:
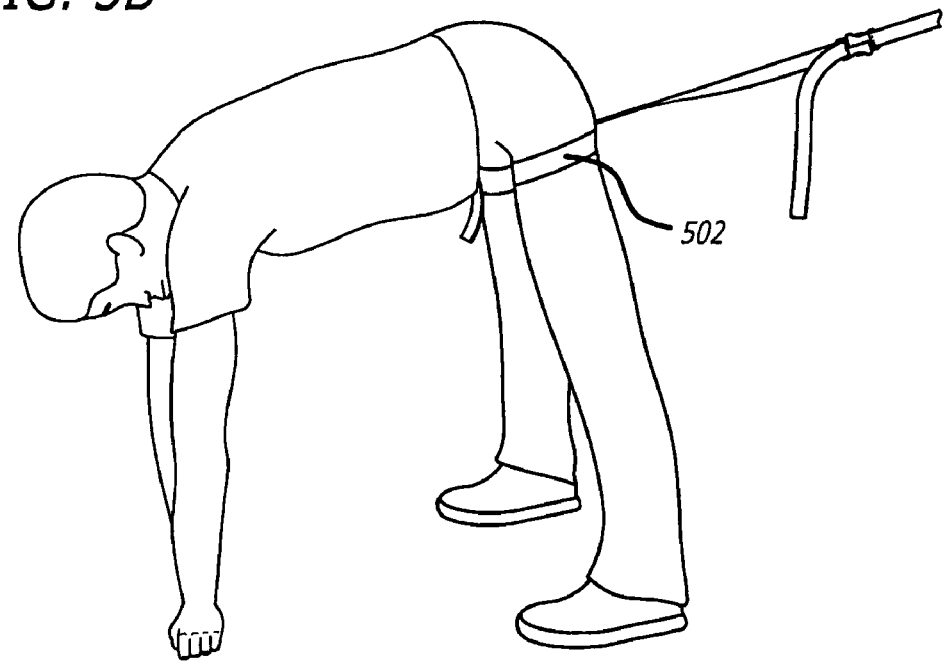

FIG. 5B shows the user with the therapeutic body strap 502 on as shown in FIG. 5A in a bent over position. By bending over at the waist, the user intensifies the stretch in the gluteus maximus, hamstrings, and other muscles. The simultaneous stretch of these muscles along with the muscles stretched by the angular motion caused by the body strap provides a user with a more synchronized stretch involving a variety of muscles.

Figure 5C:
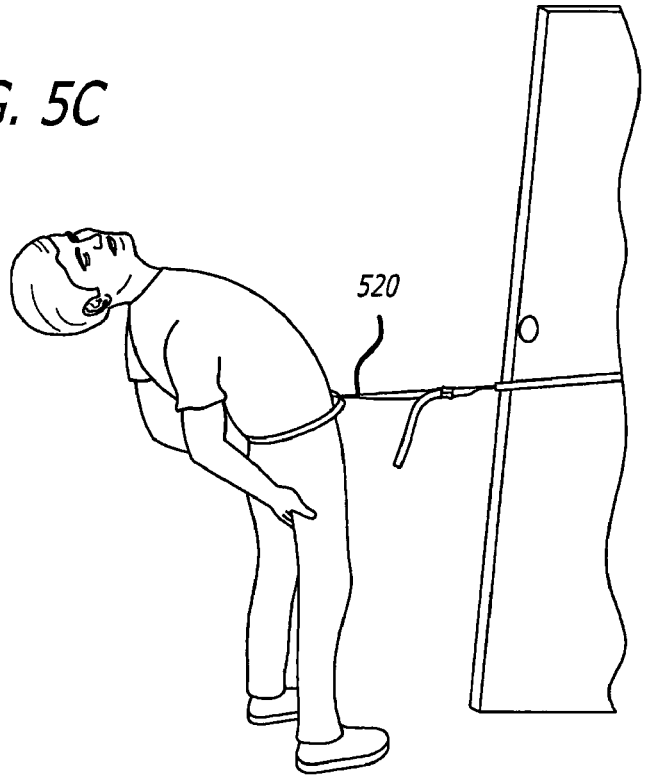

FIG. 5C shows the user with the therapeutic body strap 520 configured to create a single large loop. The user tightens the large loop around his waist and faces the attachment point. The user walks backwards to create the tautness in the strap and leans backward to stretch. The user may also turn the body strap 520 so that the attachment point is to the user's side. The user may then bend sideways to stretch the obliques among other muscles.

Figure 5D:
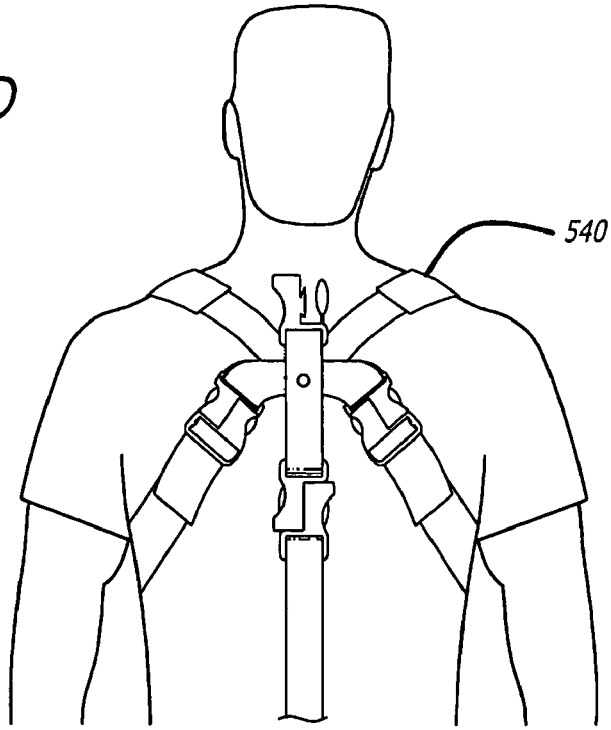

FIG. 5D shows the user wearing the therapeutic body strap 540 with the loops around the shoulders. The user may thus use the body strap 540 to stretch muscles of the upper body. For example, the muscles of the neck are extensors and flexors. The capital muscles flex and extend the head on the cervical spine and the cervical muscles flex the neck and alter its curvature. Neck muscle receptors affect the posture and the locomotion of the body as well. When the neck muscles are tight and improperly balanced, the nerves become innervated and the body loses its natural kinesthetic awareness and therefore its ability to move freely. The body strap trains and allows the muscles and tendons of the head, neck and shoulders to relax and release more naturally. When accompanied by other physical exercises, the body strap may help to restore the upper torso to a more balanced, normatonic state.

The foregoing description of implementations has been presented for purposes of illustration and description. It is not exhaustive and does not limit the claimed inventions to the precise form disclosed. Modifications and variations are possible in light of the above description or may be acquired from practicing the invention. For example, the described implementation includes software but the invention may be implemented as a combination of hardware and software or in hardware alone. Note also that the implementation may vary between systems. The claims and their equivalents define the scope of the invention.

What is claimed is:

1. A body strap comprising:

a first loop and a second loop, each loop made of a strip of material;

a central strip having a fixture point, the first and second loops being attached to the central strip at the fixture point; where the central strip includes a first length extending from the fixture point and a second length longer than the first length extending from the fixture point opposite the first length, the central strip having connecting devices on the ends of each of the first and second lengths;

an attachment portion attached at one end to the central strip and extending from the central strip for attachment to an attachment point on a stationary object at an opposite end of the attachment portion;

the first and second loops including corresponding first and second tightness adjusting mechanisms, the first and second loops being configured to surround a user's body parts with a user-adjustable tightness when the user inserts a first body part into the first loop and a second body part into the second loop;

where, when the first and second loops are attached to the attachment portion, and the attachment portion extends and is attached to the attachment point on the stationary object, the user tightens each loop using the tightness adjusting mechanism sufficient to frictionally transfer a rotational force on the user's body parts when the user moves away from the stationary object, where the rotational force is caused by a tension in the attachment portion that pulls the loops in an angular motion relative to the fixture point and the centers of the loops, where the rotational force on the user's body parts provides a stretch in an area surrounding an end of the user's body parts where the body parts connect to the rest of the user's body.

2. The body strap of claim 1 where the first and second loops each include a first and second loop length connectable by connecting devices to form the respective first and second loops.

3. The body strap of claim 2 where the connecting devices include buckles, snaps, and clips.

4. The body strap of claim 1 where the tightness adjusting mechanisms include length adjusters to vary the tension on the body part.

5. The body strap of claim 1 where the attachment portion includes an extension of the central strip.

6. The body strap of claim 1 where the attachment portion includes an attachment portion connecting device adapted to connect to a central strip connecting device on the central strip.

7. The body strap of claim 6 where the attachment portion includes an affixing device for attachment to the point of attachment.

8. The body strap of claim 7 where the affixing device includes a hook, a clamp, a loop, or a door loop configured to wrap snugly around a closed door.

9. The body strap of claim 1 further comprising a foam pad on each of the first and second loops, the foam pads configured to provide a cushion between the loops and the user's body.

10. The body strap of claim 1 where the material includes nylon, cotton, canvas, rubber, or plastic.

* * * * *